US012049677B1

(12) United States Patent
Opitz et al.

(10) Patent No.: US 12,049,677 B1
(45) Date of Patent: Jul. 30, 2024

(54) COOLING A ROLLED PRODUCT UPSTREAM OF A FINISHING TRAIN OF A HOT ROLLING MILL

(71) Applicants: Primetals Technologies Austria GmbH, Linz (AT); Primetals Technologies Germany GmbH, Erlangen (DE)

(72) Inventors: Erich Opitz, Linz (AT); Lukas Pichler, Linz (AT); Axel Rimnac, Linz (AT); Alois Seilinger, Linz (AT); Albrecht Sieber, Möhrendorf (DE); Klaus Weinzierl, Nuremberg (DE)

(73) Assignees: Primetals Technologies Austria GmbH, Linz (AT); Primetals Technologies Germany GmbH, Erlangen (DE)

( * ) Notice: Subject to any disclaimer, the term of this patent is extended or adjusted under 35 U.S.C. 154(b) by 0 days.

(21) Appl. No.: 18/566,707

(22) PCT Filed: May 20, 2022

(86) PCT No.: PCT/EP2022/063733
§ 371 (c)(1),
(2) Date: Dec. 4, 2023

(87) PCT Pub. No.: WO2022/258350
PCT Pub. Date: Dec. 15, 2022

(30) Foreign Application Priority Data

Jun. 7, 2021 (EP) ..... 21178033

(51) Int. Cl.
*C21D 8/02* (2006.01)
*B21B 37/76* (2006.01)

(52) U.S. Cl.
CPC ..... *C21D 8/0263* (2013.01); *B21B 37/76* (2013.01); *C21D 8/0226* (2013.01); *B21B 2261/20* (2013.01)

(58) Field of Classification Search
None
See application file for complete search history.

(56) References Cited

U.S. PATENT DOCUMENTS

| | | | | |
|---|---|---|---|---|
| 7,853,348 | B2 | 12/2010 | Weinzierl | |
| 2016/0288181 | A1 | 10/2016 | Weinzierl | |
| 2022/0371066 | A1* | 11/2022 | Heimann | B21B 37/74 |

FOREIGN PATENT DOCUMENTS

| | | | |
|---|---|---|---|
| DE | 102019216261 | A1 | 1/2021 |
| EP | 2873469 | A1 | 5/2015 |
| WO | 2005099923 | A1 | 10/2005 |

OTHER PUBLICATIONS

International Search Report and Written Opinion received in International Application No. PCT/EP2022/063733 dated Aug. 18, 2022, 17 pages.

(Continued)

*Primary Examiner* — Anthony M Liang
(74) *Attorney, Agent, or Firm* — Liang & Hennessey LLP; Brian Hennessey

(57) ABSTRACT

A method for cooling a rolled product in a cooling section which is located upstream of a finishing train of a hot rolling mill. The cooling section includes a cooling device which can deliver a coolant flow of a coolant onto a rolled product surface of the rolled product. In the method, a coolant flow is delivered, by means of each cooling device and in each cooling section pass, onto the rolled product surface, which flow is set to a set value that is assigned to the relevant cooling device for the cooling section pass. The set values for a cooling section pass are determined in a simulation of the cooling section pass so that surface temperatures, deter- (Continued)

mined in the simulation, of the rolled product surface upon leaving active regions of the cooling device do not exceed a minimum value for a surface temperature of the rolled product surface.

14 Claims, 7 Drawing Sheets

(56) References Cited

OTHER PUBLICATIONS

European Search Report received in European Application No. 21178033.3 dated Nov. 12, 2021, 8 pages.

* cited by examiner

COOLING A ROLLED PRODUCT UPSTREAM OF A FINISHING TRAIN OF A HOT ROLLING MILL

CROSS-REFERENCE TO RELATED APPLICATIONS

The present application is a national phase application of PCT Application No. PCT/EP2022/063733, filed May 20, 2022, entitled "COOLING A ROLLED PRODUCT UPSTREAM OF A FINISHING TRAIN OF A HOT ROLLING MILL", which claims the benefit of European Patent Application No. 21178033.3, filed Jun. 7, 2021, each of which is incorporated by reference in its entirety.

BACKGROUND OF THE INVENTION

1. Field of the Invention

The invention relates to a method and a cooling section for cooling a rolled product upstream of a finishing train of a hot rolling mill.

2. Description of the Related Art

In a hot rolling mill, a metal rolling stock, for example a steel strip, is rolled to reduce its thickness. A hot rolling mill often has a so-called roughing train and a so-called finishing train. In the roughing train, the rolling stock is rolled into a so-called transfer bar with a transfer bar thickness. The transfer bar is fed to the finishing train via a so-called intermediate roller table, in which the thickness of the rolled product is further reduced from the transfer bar thickness to a final thickness.

The rolling stock is fed to the roughing train for example at a temperature in the range of 1100° ° C. to 1200° C. For example, the rolling stock is heated to this temperature in a heating furnace before the roughing train, or the already heated rolling stock is supplied directly to the roughing train. In the intermediate roller table, the rolled product is not reshaped, i.e., its thickness is not reduced by rolling, but the rolled product is merely cooled, i.e., the temperature of the transfer bar is lowered, for example to a temperature in the range between 700° C. and 900° C.

Cooling the rolled product in the intermediate roller table serves to limit the inlet temperature of the rolled product as it enters the finishing train. The inlet temperature is limited for metallurgical reasons, for example to suppress recrystallization in the rolled product during transport of the rolled product through the finishing train, particularly in the production of so-called thermomechanically rolled products such as tubular steel or micro-alloyed steel, and/or to achieve a high surface quality, for example in the production of automotive outer skin or sheet metal for cans. Furthermore, it is often advantageous to achieve a desired inlet temperature for the finishing train as quickly as possible when transporting the rolled product through the intermediate roller table.

On the other hand, excessive cooling of the rolled product in the intermediate roller table can lead to undercooling of surface regions of a surface of the rolled product. In regions of the rolled product close to the surface, such undercooling may lead to phase transformations which impair the product quality of the product manufactured during the rolling process and should therefore be avoided. In order to prevent such undercooling, it is required that a surface temperature of a rolled product surface of the rolled product in the intermediate roller table does not fall below a certain minimum value.

EP 2 873 469 A1 discloses an operating method for cooling a flat rolled product in a cooling section with cooling devices arranged along the cooling section, from each of which a coolant can be delivered onto the rolled product when the rolled product is transported through the cooling section. Cooling capacities are determined for the cooling devices by means of a simulation of the transport of rolled product points through the cooling section and the cooling devices are controlled according to these cooling capacities during transport of the rolled product through the cooling section.

SUMMARY OF THE INVENTION

The object of the invention is to provide a method and a cooling section for cooling a rolled product upstream of a finishing train of a hot rolling mill, with which the rolled product is cooled without a surface temperature of a rolled product surface of the rolled product falling below a predetermined minimum value.

In the method according to the invention, a rolled product is cooled in a cooling section which is arranged upstream of a finishing train of a hot rolling mill and through which the rolled product is transported along a cooling section path once at a predetermined transport speed or several times in alternating directions, each time at a predetermined transport speed. The predetermined transport speed may vary over time. However, it may also be constant over time. The cooling section has a cooling device with an active region or a plurality of cooling devices arranged one behind the other along the cooling section path, each with an active region, wherein the active regions of adjacent cooling devices are directly adjacent to one another and with each cooling device in its active region a coolant flow of a coolant can be delivered onto a rolled product surface of the rolled product, which can be set between the value zero and a maximum value specific to the cooling device.

In the method according to the invention, a minimum value for a surface temperature of the rolled product surface is accepted during the transport of the rolled product through the cooling section. In order to maintain the minimum value, a set value for the coolant flow is assigned to each cooling device for each cooling section pass through the cooling section and a coolant flow is delivered onto the rolled product surface by means of each cooling device for each cooling section pass, which is set to the set value assigned to the relevant cooling device for the cooling section pass.

To determine the set values for a cooling section pass, the cooling section pass is simulated at least once for a rolled product section of the rolled product through the cooling section at the predetermined transport speed. For each simulated cooling section pass, the following values are determined successively for each cooling device

- a default value for a coolant flow to be delivered by the cooling device is received or determined at the latest immediately before the rolled product section enters the active region of the cooling device,
- based on an initial enthalpy distribution and/or initial temperature distribution in the rolled product section upon entry into the active region of the cooling device, calculating an enthalpy distribution and/or temperature distribution in the rolled product section upon exit from the active region of the cooling device using a physical model, and the set value is determined in such a way that it quasi-maximizes the coolant flow to be delivered from the cooling device onto the rolled product surface under the secondary conditions that the set value does not exceed the default value and a surface temperature of the rolled product surface derived from the initial enthalpy distribution and/or initial temperature distribution or a surface temperature of the rolled product surface derived from the calculated enthalpy distribution and/or calculated temperature distribution of the rolled product section does not fall below the minimum value when it exits the active region of the cooling device.

During the simulation of a cooling section pass, for each two active regions passed through in immediate succession by the rolled product portion during the cooling section pass, the enthalpy distribution and/or calculated temperature distribution calculated for the first active region passed through upon exit from the first active region which is passed through is furthermore assigned to the other active region as the initial enthalpy distribution and/or initial temperature distribution upon entry into the other active region. An original initial enthalpy distribution and/or original initial temperature distribution is accepted for the first cooling device through which the rolled product section passes during the cooling section pass.

In the method according to the invention, each cooling section pass of the rolled product is therefore first simulated at least once for a rolled product section of the rolled product, wherein set values for the coolant flows of all cooling devices are determined during the simulation. These set values are then used to control the cooling devices during the actual cooling section pass of the rolled product. The set value for a cooling device is determined during a simulation of a cooling section pass in such a way that the coolant flow determined by the set value is quasi-maximum under the secondary conditions that the set value does not exceed a default value and that a surface temperature of the rolled product surface determined during the simulation does not fall below a minimum value when it exits the active region of the cooling device. The default value for the coolant flow of a cooling device is either determined during the simulation or received, for example, from a higher-level control system.

The quasi-maximum coolant flow is understood here to be a coolant flow that is maximum under the specified secondary conditions or approximates the maximum coolant flow as part of a control design. This takes into account that an exact maximization of the coolant flow is not necessary in practice, since a simulation is based on a mathematical model that only models the cooling section and therefore does not exactly represent it, so that small deviations of the simulation from the real cooling process in the cooling section must be accepted anyway. Furthermore, an exact maximization of the coolant flow may require an unreasonably high computational effort and may stand in the way of carrying out the simulation as quickly as possible.

The quasi-maximization of the coolant flows advantageously enables optimized cooling of the rolled product during transport through the cooling section. The default values for the set values of the coolant flows can be used to specify a target temperature at the end of the cooling section of the rolled product, which is adapted to a desired inlet temperature of the rolled product as it enters the finishing train. The secondary condition that the surface temperatures of the rolled product surface determined during the simulation do not fall below the minimum value for the surface temperature when exiting the active regions of the cooling devices advantageously prevents the above-mentioned undercooling of the rolled product surface during the transport of the rolled product through the cooling section, which reduces the product quality. Accordingly, the minimum value is set in such a way that such undercooling of the rolled product surface is avoided.

In one embodiment of the method according to the invention, at least one cooling device, in particular each cooling device, for each simulated cooling section pass of a rolled product section is assigned the set value according to $w_i = f_i(T_i^{in}(0))w_i^V$ as the product of $f_i(T_i^{in}(0))$ and $w_i^V$, wherein i is a value of a running index assigned to the cooling device, which numbers the active regions of the cooling devices in the sequence in which they are passed through by a rolled product section during the cooling section pass. Here, $w_i^V$ is the default value for the coolant flow to be delivered by the cooling device, $T_i^{in}(0)$ is a surface temperature of the rolled product surface, derived from the initial enthalpy distribution and/or initial temperature distribution, upon entry into the active region of the cooling device, $T^{min}$ is the minimum value for the surface temperature of the rolled product surface and $\Delta T_i^{res}$ is a predeterminable reserve temperature difference. $f_i(T)$ is a function that is zero for $T \leq T^{min}$, is one for $T \geq T^{min} + \Delta T_i^{res}$, and in the interval $[T^{min}, T^{min} + \Delta T_i^{res}]$ increases strictly monotonically.

In the aforementioned embodiment of the method according to the invention, the secondary condition that the set value does not exceed the default value is realized in that the function $f_i(T)$ does not exceed the value one. The secondary condition that the surface temperature of the rolled product surface does not fall below the minimum value upon exit from the active region of the cooling device can be achieved by a suitable selection of the reserve temperature difference $\Delta T_i^{res}$. The quasi-maximization of the coolant flow is achieved by the monotonic increase of the function $f_i(T)$ from zero to one.

In an embodiment of the method according to the invention alternative to the aforementioned embodiment, the set value for at least one cooling device, in particular for each cooling device, is determined for each simulated cooling section pass by first calculating the surface temperature of the rolled product surface upon exit from the active region of the cooling device for the default value for the coolant flow of the cooling device. The set value is set equal to the default value if the surface temperature calculated for the default value does not fall below the minimum value. Otherwise, the calculation of the surface temperature upon exit from the active region is iterated for at least one coolant flow that is smaller than the default value in order to determine a set value of the coolant flow for which the calculated surface temperature upon exit from the active region matches the minimum value with sufficient accuracy. Sufficiently accurate agreement is understood to mean, for example, agreement except for an absolute or relative deviation, of which the amount does not exceed a specified tolerance value.

The aforementioned embodiment of the method according to the invention also realizes the secondary conditions mentioned above. This embodiment realizes an exact maximization of the coolant flow if the surface temperature actually corresponds to the minimum value after its iterated calculation. However, slightly exceeding the minimum value is acceptable for the reasons mentioned above and represents a quasi-maximization of the coolant flow.

In a further embodiment of the method according to the invention, for each cooling device the maximum value of the coolant flow specific to the relevant cooling device is accepted as the default value for the coolant flow for each simulated cooling section pass.

The aforementioned embodiment of the method according to the invention makes it possible, in particular, to cool the rolled product as quickly as possible during a cooling section pass by setting each default value to the maximum value of the coolant flow specific to the relevant cooling device.

In an embodiment of the method according to the invention alternative to the aforementioned embodiment, a total coolant quantity of coolant is determined for a simulation of a cooling section pass of a rolled product section, which coolant quantity is to be delivered at most in total onto the surface part of the rolled product surface belonging to the rolled product section during the cooling section pass, and the default values for the coolant flows of the simulated cooling section pass are determined in dependence on the total coolant quantity and the transport speed specified for the cooling section pass. The term "coolant quantity" always means the integral over a coolant flow during the running time of the rolled product section under consideration through the active region of one or more cooling devices. It is also possible that a coolant flow acting on a rolled product section does not always have the same effect. In this case, the coolant quantity refers to an integral weighted according to the cooling effect of the coolant flow. The physical unit of the coolant flow is, for example, $m^2/s$ corresponding to a specific coolant flow in $m^3/s$ per m width of the cooling device. The physical unit of the coolant quantity is then $m^2$ corresponding to a coolant quantity in $m^3$ per m width of the cooling device.

In the aforementioned embodiment of the method according to the invention, a cooling effect of the entire cooling section pass and thus a target temperature of the rolled product after the cooling section pass can be predetermined by the total coolant quantity. The default values for the coolant flows of the simulated cooling section pass are then determined in dependence on the total coolant quantity, so that the total coolant quantity is distributed to the cooling devices by the default values.

In a development of the above-mentioned embodiment of the method according to the invention, a target average temperature of the rolled product is received after a cooling section pass. In each simulation of a cooling section pass of a rolled product section, an average temperature of the rolled product section at the end of the cooling section pass is calculated and, if the calculated average temperature does not correspond sufficiently accurately to the target average temperature, the total amount of coolant is changed for a subsequent simulation of a cooling section pass of a rolled product section in order to bring the calculated average temperature into line with the target average temperature. This advantageously makes it possible to change the total coolant quantity iteratively in order to achieve the target average temperature with sufficient accuracy at the end of a cooling section pass. Sufficiently accurate agreement between the calculated average temperature and the target average temperature is understood to mean, for example, agreement except for an absolute or relative deviation, of which the amount does not exceed a specified tolerance value. In this further design, a target average temperature of the rolled product after the cooling section pass is thus specified as the target temperature of the rolled product and the total amount of coolant is adjusted to the target average temperature.

Furthermore, it may be provided that a residual coolant quantity is assigned to each cooling device during a simulation of a cooling section pass of a rolled product section. The total coolant quantity is assigned to the first cooling device of the cooling section pass as the residual coolant quantity. Each further cooling device is assigned, as residual coolant quantity, the residual coolant quantity of the preceding cooling device of the cooling section pass minus the coolant quantity that would be delivered by the preceding cooling device according to the coolant flow set value determined for it on the surface part of the rolled product surface belonging to the rolled product section. The default value of the coolant flow of a cooling device is then calculated according to $w_i^V = w_i^{max} \min(1, W^R/W_i^{max})$ as the product of $w_i^{max}$ and $\min(1, W^R/w_i^{max})$, wherein $w_i^{max}$ is the maximum value of the coolant flow of the cooling device, $W^R$ is the residual coolant quantity assigned to the cooling device and $W_i^{max}$ is a maximum coolant quantity that can be delivered with the cooling device onto the surface part of the rolled product surface belonging to the rolled product section during the cooling section pass. $\min(1, W^R/w_i^{max})$ denotes the minimum of the two values 1 and $W^R/W_i^{max}$ In this embodiment of the method according to the invention, the default values for the coolant flows of the cooling device are thus determined during the simulation of a cooling section pass by assigning each cooling device a residual coolant quantity and determining the default value for the cooling device in dependence on the residual coolant quantity.

Alternatively, it may be provided that if a set value is determined for a cooling device during the simulation of the cooling section pass of the rolled product section which is smaller than a default value received for the cooling device, and if there is at least one subsequent cooling device which is reached later during the cooling section pass and for which a default value received is smaller than the maximum value of the coolant flow of this cooling device, the default value for at least one such subsequent cooling device is increased in order to adapt the total quantity of coolant to be delivered onto the surface part of the rolled product surface belonging to the rolled product section during the cooling section pass to the total quantity of coolant determined for the cooling section pass. This embodiment of the method according to the invention is based on default values received at the beginning of a simulation. The default values are adjusted during the simulation if necessary, if the set value determined for a cooling device during the simulation falls below the associated default value. When adapting the default values, default values for subsequent cooling devices are increased, if possible, in order to adapt the cooling effect of the cooling section pass to the cooling effect corresponding to the total coolant quantity.

In a further embodiment of the method according to the invention, a one-dimensional heat conduction equation describing the enthalpy distribution and/or temperature distribution in the rolled product section along a rolled product thickness direction is solved to calculate the enthalpy distribution and/or temperature distribution in the rolled product section upon exit from the active region of a cooling device during a simulation of a cooling section pass of the rolled product section. To solve the heat conduction equation, for example, boundary conditions are taken into account which parameterize cooling of the rolled product section by thermal radiation, coolant delivered onto the rolled product surface, heat dissipated to the ambient air and heat dissipated to the transport rollers transporting the rolled product. The rolled product thickness direction is a direction from a top surface to a bottom surface of the rolled product or vice versa from the bottom surface to the top surface of the rolled product.

The aforementioned embodiment of the method according to the invention takes into account that a heat flow in the longitudinal or transverse direction within the rolled product is negligible compared to a heat flow in the direction of the thickness of the rolled product. Therefore, a one-dimensional heat conduction equation describing the enthalpy distribution and/or temperature distribution in the rolled product section along the rolled product thickness direction can be used to calculate the enthalpy distribution and/or temperature distribution in the rolled product section with sufficient accuracy. This considerably reduces the calculation effort and the calculation time compared to the use of a two- or three-dimensional heat conduction equation. The aforementioned boundary conditions take into account the main influences on the development of the enthalpy distribution and temperature distribution in the rolled product.

In a further embodiment of the method according to the invention, the surface temperature of a surface part of the rolled product surface belonging to the rolled product section is measured at at least one measurement point, which is passed by a rolled product section before a cooling section pass, and the original initial enthalpy distribution and/or original initial temperature distribution for a simulation of a cooling section pass of the rolled product section are determined in dependence on the at least one measured surface temperature.

The method according to the invention can also be carried out for a rolled product top surface or a rolled product bottom surface or separately for the rolled product top surface and the rolled product bottom surface of the rolled product.

A cooling section according to the invention for cooling a rolled product upstream of a finishing train of a hot rolling mill comprises

- a cooling device or a plurality of cooling devices arranged one behind the other along a cooling path through the cooling section, with each of which a coolant flow of a coolant can be delivered onto a rolled product surface of the rolled product, which can be set between the value zero and a maximum value specific to the cooling device,
- a plurality of transport rollers which are designed to transport the rolled product along the cooling section path through the cooling section, and
- a control unit which is designed to operate the cooling section in accordance with the method according to the invention according to one of the preceding claims.

In one embodiment of a cooling section according to the invention with a plurality of cooling devices, the cooling devices are arranged along the cooling section path according to their maximum values of the deliverable coolant flows, so that the maximum values decrease monotonically towards the finishing train. This enables rapid cooling of the rolled product at the start of the cooling section. Furthermore, the cooling devices in the rear part of the cooling section can be designed to be simpler and more cost-effective than the cooling devices in the front part of the cooling section, as the surface temperature of the rolled product surface has generally already reached the minimum value in the rear part of the cooling section and therefore only a low cooling capacity is required there.

BRIEF DESCRIPTION OF THE DRAWINGS

The properties, features and advantages of the present invention described above and the manner in which they are achieved will be more clearly and distinctly understood in conjunction with the following description of exemplary embodiments, which will be explained in greater detail in conjunction with the drawings, in which.

DETAILED DESCRIPTION

Corresponding parts are provided with the same reference signs in the figures.

Figure 1:
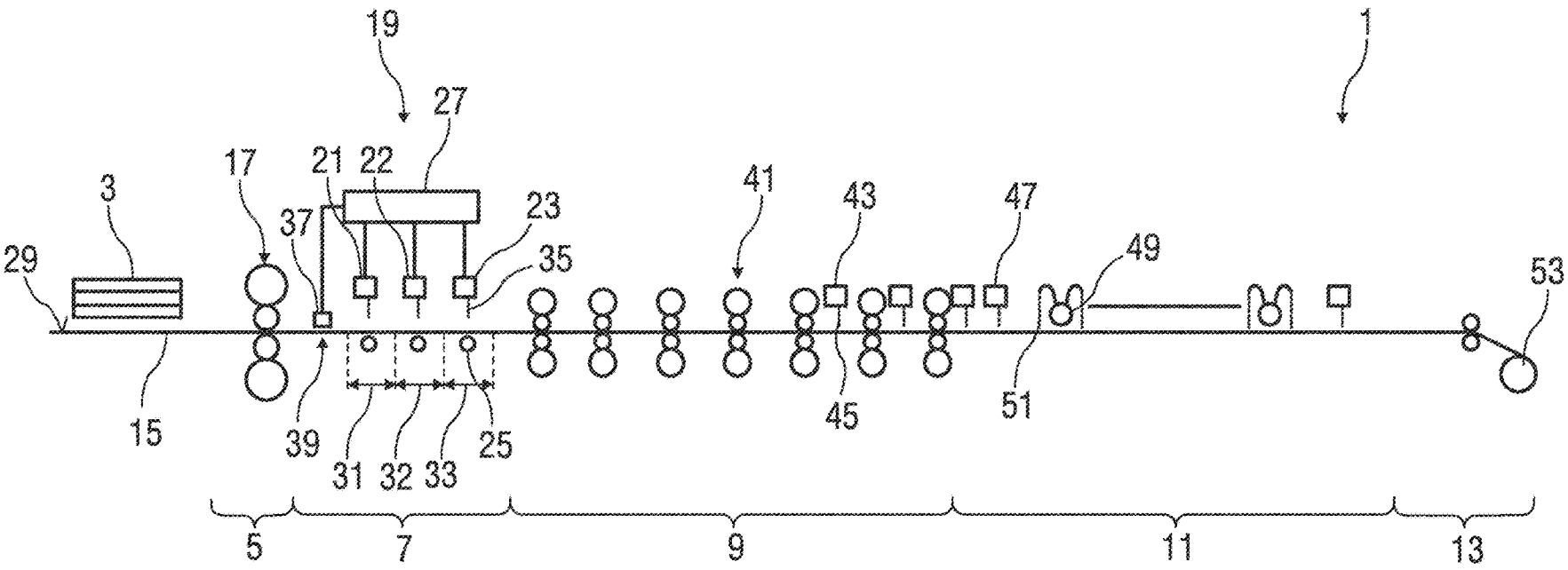
FIG. 1 shows a schematic view of a hot rolling mill.

FIG. 1 (FIG. 1) schematically shows a hot rolling mill 1. The hot rolling mill 1 comprises a heating furnace 3, a roughing train 5, an intermediate roller table 7, a finishing train 9, a run-out cooling area 11 and a coiler area 13. A rolled product 15 is transported through the hot rolling mill 1 in the direction from the heating furnace 3 to the coiler area 13.

The heating furnace 3 is arranged upstream of the roughing train 5 and is set up to heat the rolled product 15 to a specific temperature, for example in the range from 1100° C. to 1200° C.

The roughing train 5 has at least one roughing train rolling stand 17. In the roughing train 5, the rolled product 15 is rolled into a transfer bar with a transfer bar thickness, for example in the range between 30 mm and 170 mm.

The intermediate roller table 7 transports the rolled product 15 from the roughing train 5 to the finishing train 9 at a predetermined transport speed. The intermediate roller table 7 has an exemplary embodiment of a cooling section 19 according to the invention. The cooling section 19 comprises a plurality of cooling devices 21, 22, 23 arranged one behind the other along a cooling section path through the cooling section 19, a plurality of transport rollers 25, which are designed to transport the rolled product 15 along the cooling section path through the cooling section, and a control unit 27, which is designed to operate the cooling section 19 in accordance with an exemplary embodiment of the method according to the invention for cooling the rolled product 15. Exemplary embodiments of the method according to the invention are described below with reference to FIGS. 2 to 6. FIG. 1 shows an example of a cooling section 19 with three cooling devices 21, 22, 23. However, the cooling section 19 can also have a different number of cooling devices 21, 22, 23.

With each cooling device 21, 22, 23, a coolant flow of a coolant 35, which can be set between the value zero and a maximum value specific to the cooling device 21, 22, 23, can be delivered onto a rolled product surface 29 of the rolled product 15 in an active region 31, 32, 33 of the cooling device 21, 22, 23. The coolant 35 is water, for example. In FIG. 1, the rolled product surface 29 is a top surface of the rolled product 15. In other exemplary embodiments, the rolled product surface 29 can be a bottom surface of the rolled product 15, wherein the cooling devices 21, 22, 23 are then arranged below the rolled product 15. Furthermore, the cooling section 19 can have cooling devices 21, 22, 23 for both the top surface and the bottom surface of the rolled product 15. In the latter case, the method according to the invention is carried out separately for the top surface and for the bottom surface of the rolled product 15.

Each cooling device 21, 22, 23 is designed, for example, as a cooling bar which extends along a width of the rolled product 15 and has a plurality of nozzles with which coolant 35 can be delivered onto the rolled product surface 29. The active regions 31, 32, 33 are assigned to the cooling devices 21, 22, 23 in such a way that the active regions 31, 32, 33 of adjacent cooling devices 21, 22, 23 are directly adjacent to one another. For example, the cooling devices 21, 22, 23 are arranged along the cooling path according to their maximum values of the deliverable coolant flows, so that the maximum values decrease monotonically towards the finishing train 9.

In the intermediate roller table 7, a measuring device 37 is also arranged upstream of the cooling section 19 at a measurement point 39 and is set up to detect a surface temperature of the rolled product surface 29. For example, the measuring device 37 has a pyrometer for this purpose.

The finishing train 9 comprises a plurality of finishing train rolling stands 41 and finishing train cooling devices 43, each of which is arranged between two finishing train rolling stands 41 and with each of which finishing train coolant 45 can be delivered onto the rolled product surface 29. In the finishing train 9, the thickness of the rolled product 15 is reduced to a final thickness using the finishing train rolling stands 41.

In the outlet cooling area 11 there are arranged outlet cooling devices 47, 49, with which outlet coolant 51 can be delivered onto the rolled product surface 29. In the outlet cooling area 11, the rolled product 15 is cooled down after the finishing train 9.

At least one rolled product coiler 53 is arranged in the coiler area 13 and is designed to wind up the rolled product 15.

Figure 2:
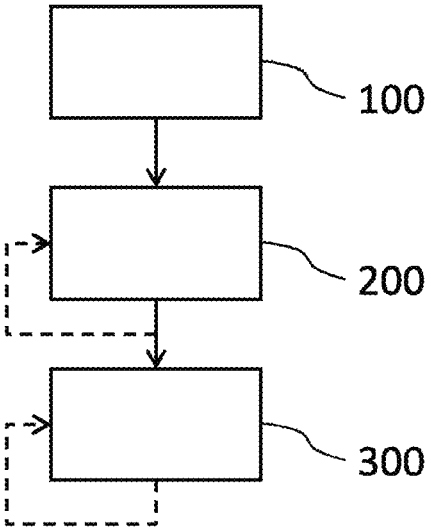
FIG. 2 shows a flow chart of the method according to the invention.

FIG. 2 (FIG. 2) shows a flow chart of the method according to the invention with method steps 100, 200, 300 for cooling the rolled product 15 in the cooling section 19.

In a first method step 100, the control unit 27 receives a minimum value $T^{min}$ for a surface temperature of the rolled product surface 29 during the transport of the rolled product 15 through the cooling section 19. The minimum value $T^{min}$ is specified, for example, by a higher-level control system (not shown) or by an operator of the hot rolling mill 1. The minimum value $T^{min}$ is a surface temperature of the rolled product surface 29 which should not fall below during the transport of the rolled product 15 through the cooling section 19.

In a second method step 200, for a cooling section pass of the rolled product 15 through the cooling section 19, each cooling device 21, 22, 23 is assigned a set value for the coolant flow to be delivered from the cooling device 21, 22, 23 onto the rolled product surface 29. Exemplary embodiments of the second method step 200 are described in greater detail below with reference to FIGS. 3 to 6.

In a third method step 300, a coolant flow is delivered onto the rolled product surface 29 by means of each cooling device 21, 22, 23 during the cooling section pass and is set to the set value assigned to the relevant cooling device 21, 22, 23 for the cooling section pass in the second method step 200.

The method steps 200 and 300 can also be carried out several times, so that the set values of the cooling devices 21, 22, 23 can be changed during the transport of the rolled product 15 through the cooling section 19. This is indicated in FIG. 2 by the dashed arrow symbols.

For example, the rolled product 15 is divided into a plurality of rolled product sections which pass through the active regions 31, 32, 33 of the cooling devices 21, 22, 23 one after the other, and the method steps 200 and 300 are carried out successively for each rolled product section. In this case, in the second method step 200, a set value for the coolant flow to be delivered by the cooling device 21, 22, 23 onto the part of the rolled product surface 29 belonging to the rolled product section is assigned to each cooling device 21, 22, 23 for the cooling section pass of a rolled product section through the cooling section 19.

Figure 3:
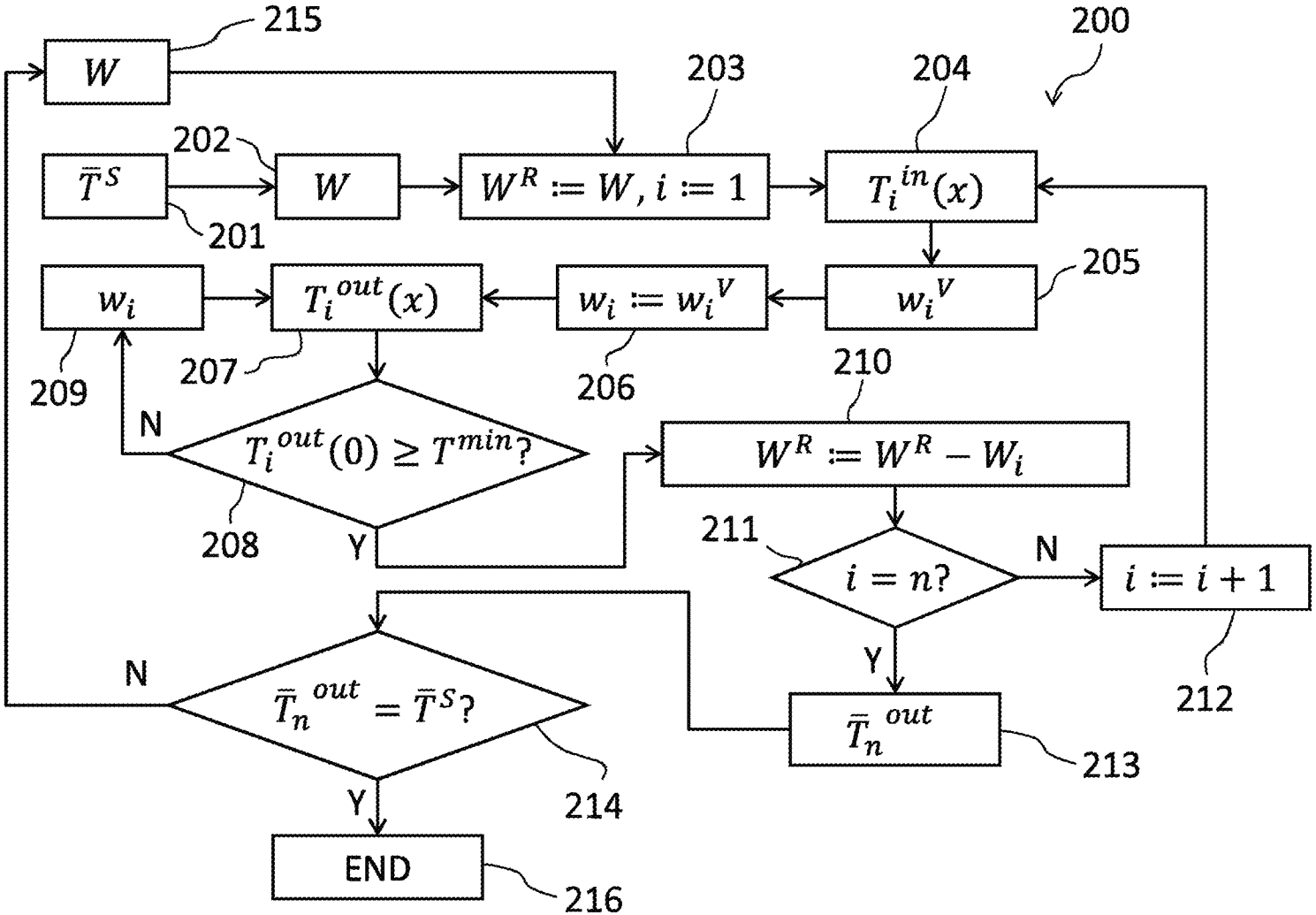
FIG. 3 shows a flow chart of a first exemplary embodiment of a method step of the method according to the invention.

In the third method step 300, a flow of coolant is accordingly delivered by means of each cooling device 21, 22, 23 onto the part of the rolled product surface 29 belonging to the rolled product section during the cooling section pass of a rolled product section and is set to the set value assigned to the relevant cooling device 21, 22, 23 for the cooling section pass of the rolled product section in the second method step 200. Preferably, for each cooling device 21, 22, 23, a delay period is taken into account which elapses between the changing of the set value of the cooling device 21, 22, 23 and the change in the coolant flow actually delivered by the cooling device 21, 22, 23 to the changed set value, in that the set value of the cooling device 21, 22, 23 is changed at a time which is earlier, by the delay period, than the time at which the rolled product section enters the active region 31, 32, 33 of the cooling device 21, 22, 23. FIG. 3 (FIG. 3) shows a first exemplary embodiment of the second method step 200 with sub-steps 201 to 216 for determining the set values of the cooling devices 21, 22, 23 for a cooling section pass of the rolled product 15 through the cooling section 19. In this case, the cooling section pass is simulated at least once for a rolled product section of the rolled product 15 at the transport speed specified for it. A running index i=1, . . . , n numbers the active regions 31, 32, 33 of the cooling devices 21, 22, 23 in the order in which they are passed through by a rolled product section during the cooling section pass, wherein n denotes the number of cooling devices 21, 22, 23 (as already explained above, only three cooling devices 21, 22, 23 are shown by way of example in FIG. 1; the method is described below for a general number of cooling devices 21, 22, 23).

In a first sub-step 201, a target average temperature $\overline{T}^S$ of the rolled product section is accepted after the cooling section pass, i.e., after passing through all active regions 31, 32, 33. After the first sub-step 201, a second sub-step 202 is carried out.

In the second sub-step 202, a total coolant quantity W of coolant 35 is accepted, which is to be delivered at most in total during the cooling section pass onto the surface part of the rolled product surface 29 belonging to the rolled product section. After the second sub-step 202, a third sub-step 203 is carried out.

In the third sub-step 203, a residual coolant quantity $W^R$ is assigned the total coolant quantity W as initial value and the running index i is assigned the value 1 as initial value. After the third sub-step 203, a fourth sub-step 204 is carried out for the running index value i=1.

In the fourth sub-step 204, an initial temperature distribution $T_i^{in}(x)$ in the rolled product section along a rolled product thickness direction upon entry into the active region 31, 32, 33 with the current value of the running index i is accepted or adopted. The rolled product thickness direction runs perpendicular to a transport direction of the transport of the rolled product 15 through the cooling section 19 from the top surface to the bottom surface of the rolled product 15. x denotes a variable along the rolled product thickness direction, wherein x=0 is a point on the top surface of the rolled product 15 and x=d is a point on the bottom surface of the rolled product 15 opposite the point x=0 along the rolled product thickness direction.

For the running index value i=1, an original initial temperature distribution is accepted as initial temperature distribution $T_1^{in}(x)$, which is derived, for example, from a surface temperature of the rolled product surface 29, which was recorded by the measuring device 37, and/or from a heating temperature of the heating furnace 3. For example, the initial temperature distribution $T_1^{in}(x)$ is modeled as a parabolic temperature distribution in the rolled product thickness direction between an assumed core temperature in the middle between a top surface and a bottom surface of the rolled product 15 and the surface temperature recorded by the measuring device 37, wherein the core temperature is derived, for example, from the heating temperature of the heating furnace 3.

For each running index value i>1 the temperature distribution $T_{i-1}^{out}(x)$ determined out in the previous execution of sub-step 207 for the active region 31, 32, 33 with the running index value i−1 was determined as initial temperature distribution $T_i^{in}(x)$:

$$i>1:\ T_i^{in}(x)=T_{i-1}^{out}(x) \tag{1}$$

Alternatively or in addition to the initial temperature distribution $T_i^{in}(x)$, in sub-step 204 an initial enthalpy distribution $h_i^{in}(x)$ can be accepted or adopted in the same way for the current running index value i. After the fourth sub-step 204, a fifth sub-step 205 is carried out.

In the fifth sub-step 205, a default value $w_i^V$ for the coolant flow of the cooling device 21, 22, 23 is determined using the current value of the running index i. For this purpose, for example, a maximum coolant quantity $w_i^{max}$ which can be delivered by the cooling device 21, 22, 23 to the surface part of the rolled product surface 29 belonging to the rolled product section during the cooling section pass is determined. The maximum coolant quantity $W_i^{max}$ depends in particular on the maximum value $w_i^{max}$ of the deliverable coolant flow specific to the cooling device 21, 22, 23 and on the specified transport speed. The default value $w_i^V$ is then defined as the product of the maximum value $w_i^{max}$ and of the minimum min(1, $W^R/w_i^{max}$) of the two values 1 and $W^R/w_i^{max}$:

$$w_i^V=w_i^{max}\min(1,W^R/W_i^{max}) \tag{2}$$

In other words, the default value $w_i^V$ corresponds to the maximum value $w_i^{max}$ of the deliverable coolant flow specific to the cooling device 21, 22, 23 if the current value of the residual coolant quantity $W^R$ is greater than the maximum coolant quantity $W_i^{max}$ or equal to the maximum coolant quantity $w_i^{max}$. Otherwise, the default value $w_i^V$ is the quotient of the current value of the residual coolant quantity $W^R$ and of an effective throughput time $W_i^{max}/w_i^{max}$ of the rolled product section through the active region 31, 32, 33 with the current value of the running index i. After the fifth sub-step 205, a sixth sub-step 206 is carried out.

In the sixth sub-step 206, the set value $w_i$ of the coolant flow for the cooling device 21, 22, 23 with the current value of the running index i is assigned, as initial value, the default value $w_i^V$ determined for this coolant flow in the previous execution of the fifth sub-step 205. After the sixth sub-step 206, a seventh sub-step 207 is carried out.

In the seventh sub-step 207, a temperature distribution $T_i^{out}(x)$ in the rolled product section along the rolled product thickness direction upon exit from the active region 31, 32, 33 is calculated using the current value of the running index i. The temperature distribution $T_i^{out}(x)$ is calculated on the basis of a physical model which describes the temporal development of the temperature distribution in the rolled product section using a one-dimensional heat conduction equation. The heat conduction equation is calculated for the boundary conditions listed below with the associated initial temperature distribution $T_i^{in}(x)$ as the temperature distribution upon entry into the relevant active region 31, 32, 33.

Alternatively or in addition to the temperature distribution $T_i^{out}(x)$ in the seventh sub-step 207, an enthalpy distribution $h_i^{out}(x)$ in the rolled product section upon exit from the active region 31, 32, 33 can be calculated analogously with the current value of the running index i if, in the previous execution of the fourth sub-step 204, an associated initial enthalpy distribution $h_i^{in}(x)$ was accepted or adopted upon entry into this active region 31, 32, 33.

A simple form of the heat conduction equation is $$\frac{\partial T(x,t)}{\partial t}=a\frac{\partial^2 T(x,t)}{\partial x^2} \tag{3}$$

Here, $$a=\frac{\lambda}{\varrho c}$$

is the thermal diffusivity of the rolled product 15, wherein A denotes its thermal conductivity, ∂ its density and c its heat capacity.

The boundary conditions required for the heat conduction equation (3) are the heat flux density $j_o$ for the top surface (x=0) and the heat flux density $j_u$ for the bottom surface (x=d) of the rolled product 15. For example, for the top surface, $$j_o(T_o)=\varepsilon_o(T_o^4-T_e^4)+f_L(T_o,T_e,v)+f_w(T_o,v,T_w,w_{oi}) \tag{4a}$$

is used, and for the bottom surface $$j_u(T_u)=\varepsilon_u(T_u^4-T_e^4)+f_L(T_u,T_e,v)+f_R(T_u,T_e,v)+f_w(T_u,v,T_w,w_{ui}) \tag{4b}$$

is used. Here, v is the average transport speed during the passage through the active region, henceforth simply referred to as transport speed, $\varepsilon_o$ is a radiation coefficient of thermal radiation from the top surface, and $\varepsilon_u$ is a radiation coefficient of thermal radiation from the bottom surface, which is less than $\varepsilon_o$ on account of the reflection of heat radiation at the transport rollers 25. $f_L(T_o,T_e,v)$ and $f_L(T_u,T_e,v)$ are functions that describe the cooling effect of the ambient air in dependence on the surface temperature $T_o$ of the rolled product 15 at the top surface or on the surface temperature $T_u$ of the rolled product 15 at the bottom surface, the ambient temperature $T_e$ and the transport speed v describe. $f_R(T_u,T_e,v)$ is a function that describes the cooling effect of the transport rollers 25 in dependence on the surface temperature $T_u$, the ambient temperature $T_e$ and the transport speed v. $f_w(T_o,v,T_w,w_{oi})$ is a function that describes the cooling effect of a top-side cooling device 21, 22, 23, i.e., a cooling device 21, 22, 23 that cools the top surface of the rolled product 15, with the running index value i in dependence on the surface temperature $T_o$, the transport speed v, the coolant temperature $T_w$ and the coolant flow of the cooling device 21, 22, 23 given by the set value $w_{oi}$. $f_w(T_u,v,T_w,w_{ui})$ is accordingly a function that describes the cooling effect of a bottom-side cooling device 21, 22, 23 with the running index value i in dependence on the surface temperature $T_u$, the transport speed v, the coolant temperature $T_w$ and the coolant flow of the cooling device 21, 22, 23 given by the set value $w_{ui}$.

The function $f_w$ is often separated to enable simpler parameterization, for example according to $$f_w(T,v,T_w,W)=f_T(T,v)g_T(T_w)h_w(w) \tag{4c}$$

with the easier to describe dependencies of the cooling effect $f_T(T,v)$ on the transport speed v and the relevant surface temperature $T=T_o$ or $T=T_u$, the dependence of the cooling effect $g_T(T_w)$ on the coolant temperature $T_w$ and the dependence of the cooling effect $h_w(w)$ on the coolant flow $w=w_{oi}$ or $w=w_{ui}$ of a top-side or bottom-side cooling device 21, 22, 23 with the running index value i. At points along the cooling path where no coolant flow is delivered from a top-side cooling device 21, 22, 23 onto the rolled product 15, the following applies $f_w(T_o,v,T_w,w_{oi})=0$. The following applies accordingly $f_w(T_u,v,T_w,w_{ui})=0$ at points along the cooling section path where no coolant flow is delivered from a bottom-side cooling device 21, 22, 23 onto the rolled product 15.

If the method according to the invention is carried out for top-side and bottom-side cooling devices 21, 22, 23, it is carried out separately for the top-side cooling devices 21, 22, 23 and the bottom-side cooling devices 21, 22, 23. In FIG. 3, the following therefore applies to the top-side cooling devices 21, 22, 23: $w_i=w_{oi}$, and for the bottom-side cooling devices 21, 22, 23 accordingly $w_i=w_{ui}$, etc., wherein the running range of the running index i for the top-side cooling devices 21, 22, 23 can differ from the running range of the running index i for the bottom-side cooling devices 21, 22, 23.

An alternative form of the heat conduction equation is $$\frac{\partial}{\partial t}\sum_{k=1}^{m} p_k h_k - \frac{\partial}{\partial x}\left[\frac{\lambda(h,\ p_1,\ \ldots\ ,\ p_m)}{\rho}\frac{\partial T(h,\ p_1,\ \ldots\ ,\ p_m)}{\partial x}\right] = 0 \tag{5}$$

In equation (5), $p_k$, k=1, . . . , m are phase fractions of the rolled product 15, for example an austenite fraction, a ferrite fraction, a cementite fraction and/or other fractions. The phase fractions are always non-negative and their sum is one. The variable h is an enthalpy density, wherein $$h = \sum_{k=1}^{m} p_k h_k.$$

Furthermore, for each phase fraction there are known dependencies between the enthalpy density $h_k$ of the relevant phase fraction and the associated temperature $T_k$, i.e., the temperature $T_k=T_k(h_k)$ is a strictly monotonically increasing function of the enthalpy density fraction $h_k$. The following applies here: $T_1(h_1)=T_2(h_2)= \ldots =T_m(h_m)=T$, since the temperature at one point x can only have one value that is the same for all phase fractions. By solving this system of equations, the function $T(h, p_1, \ldots, p_m)$ can be calculated. Accordingly, the thermal conductivity λ can be expressed as a function of the enthalpy density h and the phase fractions $p_1, \ldots, p_m$. The variable p denotes the density of the rolled product 15, which is assumed to be the same for all phase fractions.

The phase fractions can be calculated here as required, in particular coupled with the solution of the heat conduction equation. For example, a coupled differential equation system can be used for the phase components:

$$\frac{dp_k}{dt} = f_{pk}(T,\ p_1,\ \ldots\ ,\ p_m),\ k = 1,\ \ldots\ ,\ m. \tag{6}$$

Equation (3) and equations (5) and (6) are solved with the boundary conditions according to equations (4a) and (4b) for an initial temperature distribution $T_i^{in}(x)$ and an initial enthalpy distribution $h_i^{in}(x)$ and initial phase fractions $p_{1i}, \ldots, p_{mi}$ in order to calculate a temperature distribution $T_i^{out}(x)$ or an enthalpy distribution $h_i^{out}(x)$ and phase fractions $p_{1i}^{out}, \ldots, p_{mi}^{out}$ in the rolled product section upon exit from the active region 31, 32, 33 with the current value of the running index i.

The functions $f_L$, $f_w$, $f_R$ included in equations (4a) and (4b) are suitably parameterized in a manner known from the prior art, for example as so-called B-splines. In some cases, closed representations can also be specified. In this regard, reference is made, for example, to the publication W. Timm et al. (2002), Modelling of heat transfer in hot strip mill runout table cooling, Steel Research, 73: 97-104, https://doi.org/10.1002/srin.200200180. There, in equation (6), the functions $f_L$, $f_w$, $f_R$ each as the product of a heat flow constant $\dot{Q}_i$ and dimensionless correction functions $f_i$ are used, wherein the index i stands for the particular type of cooling (by air, coolant or transport rollers), see furthermore, for example, equations (7) to (9) of the aforementioned publication for cooling by air, equations (11) to (14) for (various types of) cooling by coolant and equation (10) for cooling by transport rollers.

After the seventh sub-step 207, an eighth sub-step 208 is carried out.

In the eighth sub-step 208, it is checked whether the temperature $T_i^{out}(0)$, calculated in the seventh sub-step 207, at the rolled product surface 29 upon exit from the active region 31, 32, 33 with the current value of the running index i exceeds the minimum value $T^{min}$ or equals the minimum value $T^{min}$ (in the event that the rolled product surface 29 is the bottom surface of the rolled product 15, here $T_i^{out}(0)$ should be replaced by $T_i^{out}(d)$ or the selection of the coordinate x should be adapted in such a way that x=0 denotes the bottom surface of the rolled product 15). If this is not the case, a ninth sub-step 209 is performed. Otherwise, a tenth sub-step 210 is carried out.

The ninth sub-step 209 is therefore always carried out when the calculated surface temperature of the rolled product surface 29 upon exit from the active region 31, 32, 33 with the current value of the running index i falls below the minimum value $T^{min}$, i.e., when the current set value $w_i$ for this value of the running index i is too high. In the ninth sub-step 209, this set value $w_i$ is therefore assigned a new (smaller) value, for example using a Newton method, in such a way that the surface temperature calculated for the new set value $w_i$ is approximated to the minimum value $T^{min}$. The seventh sub-step 207 and the eighth sub-step 208 are then carried out again, i.e., the surface temperature upon exit from the active region 31, 32, 33 with the current value of the running index i is calculated for the new set value $w_i$. This is repeated until the calculated surface temperature matches or slightly exceeds the minimum value $T^{min}$ or slightly exceeds it, for example by a maximum of 10° C., preferably by a maximum of 5° C. The tenth sub-step 210 is then carried out.

In the tenth sub-step 210, the value of the residual coolant quantity $W^R$ is changed by subtracting from the previous value the coolant quantity $W_i$ corresponding to the set value $w_i$, which is delivered by the cooling device 21, 22, 23 with the current value of the running index i to the surface part of the rolled product surface 29 belonging to the rolled product section. The coolant quantity $W_i$ can be calculated, for example, according to $$W_i = \frac{w_i W_i^{max}}{w_i max}. \tag{7}$$

After the tenth sub-step 210, an eleventh sub-step 211 is carried out.

In the eleventh sub-step 211, it is checked whether the current value of the running index i has reached the final value n, i.e., whether the simulated cooling section pass has ended. If this is not the case, a twelfth sub-step 212 is carried out. Otherwise, a thirteenth sub-step 213 is carried out.

In the twelfth sub-step 212, the value of the running index i is incremented. The fourth sub-step 204 is then carried out for the new value of the running index i is carried out.

In the thirteenth sub-step 213, an average temperature of the rolled product section is calculated after the simulated cooling section pass, i.e., after the simulated pass through all active regions 31, 32, 33. This average temperature is calculated, for example, according to $$\overline{T}_n^{out} = \frac{1}{d}\int_0^d T_n^{out}(x)dx \tag{8}$$

from the temperature distribution $T_n^{out}(x)$ calculated in the previous execution of the seventh sub-step 207. According to equation (8), the calculated average temperature after the simulated pass through all active regions 31, 32, 33 is a temperature averaged over the thickness of the rolled product 15 upon exit from the active region with the running index value i=n, i.e., upon exit from the active region last passed through during the cooling section pass. After the thirteenth sub-step 213, a fourteenth sub-step 214 is carried out.

In the fourteenth sub-step 214, it is checked whether the average temperature $\overline{T}_n^{out}$ calculated in the previous execution of the thirteenth sub-step 213 matches, with sufficient accuracy, the target average temperature $\overline{T}^S$ of the rolled product section after the cooling section pass. A sufficiently accurate match is understood to mean, for example, a match except for an absolute or relative deviation, of which the amount does not exceed a predetermined tolerance value. If the average temperature $\overline{T}_n^{out}$ does not match the target average temperature $\overline{T}^S$ with sufficient accuracy, a fifteenth sub-step 215 is carried out after the fourteenth sub-step 214. Otherwise, a sixteenth sub-step 216 is carried out after the fourteenth sub-step 214.

The fifteenth sub-step 215 is therefore carried out if the calculated average temperature $\overline{T}_n^{out}$ after the simulated cooling section pass does not match the target average temperature $\overline{T}^S$ with sufficient accuracy. If the calculated average temperature $\overline{T}_n^{out}$ exceeds the target average temperature $\overline{T}^S$, this indicates that the total coolant quantity W on which the simulated cooling section pass was based was too small. If the calculated average temperature $\overline{T}_n^{out}$ falls below the target average temperature $\overline{T}^S$, this indicates that the total coolant quantity W on which the simulated cooling section pass was based was too large. Therefore, in the fifteenth sub-step 215, the value of the total coolant quantity W is changed, for example by an amount that depends on the deviation of the calculated average temperature $\overline{T}_n^{out}$ from the target average temperature $\overline{T}^S$. This allows the calculated average temperature $\overline{T}_n^{out}$ after the next simulated cooling section pass to be approximated to the target average temperature $\overline{T}^S$. The adjustment of the total coolant quantity W can be improved in later simulated cooling section passes using a Newton method, for example.

After the fifteenth sub-step 215, the third sub-step 203 is carried out with the new value of the total coolant quantity W, i.e., a further simulation of the cooling section pass of the rolled product section is started with the changed value of the total coolant quantity W. The simulation of the cooling section pass is repeated with a changed value of the total coolant quantity W until the calculated average temperature $\overline{T}_n^{out}$ after a simulated cooling section pass matches the target average temperature $\overline{T}^S$ with sufficient accuracy, or the value of the total coolant quantity W becomes zero or reaches or exceeds a maximum value $$W^{max} = \sum_{i=1}^{n} W_i^{max}$$

or the residual coolant quantity $W^R$ once sub-step 210 has been carried out for i=n has not become zero, i.e., the initial total coolant quantity W was too large. The maximum value $W^{max}$ is a maximum coolant quantity which can be delivered by all cooling devices 21, 22, 23 together onto the part of the rolled product surface 29 belonging to the rolled product section during the cooling section pass (at the transport speed specified for it) of the rolled product section.

If the calculated average temperature $\overline{T}_n^{out}$ after a simulated cooling section pass corresponds with sufficient accuracy to the target average temperature $\overline{T}^S$, the sixteenth sub-step 216 is carried out after the fourteenth sub-step 214 of this simulated cooling section pass.

If the value of the total coolant quantity W becomes zero, each set value $w_i$, i=1, . . . , n is assigned the value zero, i.e., ∀i: $w_i$=0 is used, and then the sixteenth sub-step 216 is carried out. If the value of the total coolant quantity W reaches or exceeds the maximum value $W^{max}$, each set value $w_i$ is assigned the maximum value $w_i^{max}$ specific to the relevant cooling device 21, 22, 23, i.e., ∀i: $w_i$=$w_i^{max}$ is used, and then the sixteenth sub-step 216 is carried out. The cases in which the total coolant quantity W becomes zero or reaches or exceeds the maximum value $W^{max}$ are not shown in FIGS. 3 and 4 for the sake of clarity. These cases are exceptions, since in the case of W=0 no active cooling of the rolled product 15 in the cooling section 19 is implied and in the case of W=$W^{max}$ a maximum possible cooling of the rolled product 15 in the cooling section 19 is implied, in which the maximum possible coolant flow specific to the cooling device 21, 22, 23 is delivered by each cooling device 21, 22, 23.

In the sixteenth sub-step 216, the second method step 200 is ended and the last coolant flow set value $w_i$ of the coolant flow determined in the method step 200 is stored for each cooling device 21, 22, 23. The coolant flow of the relevant cooling device 21, 22, 23 is set to this set value $w_i$ in the third method step 300.

Figure 4:
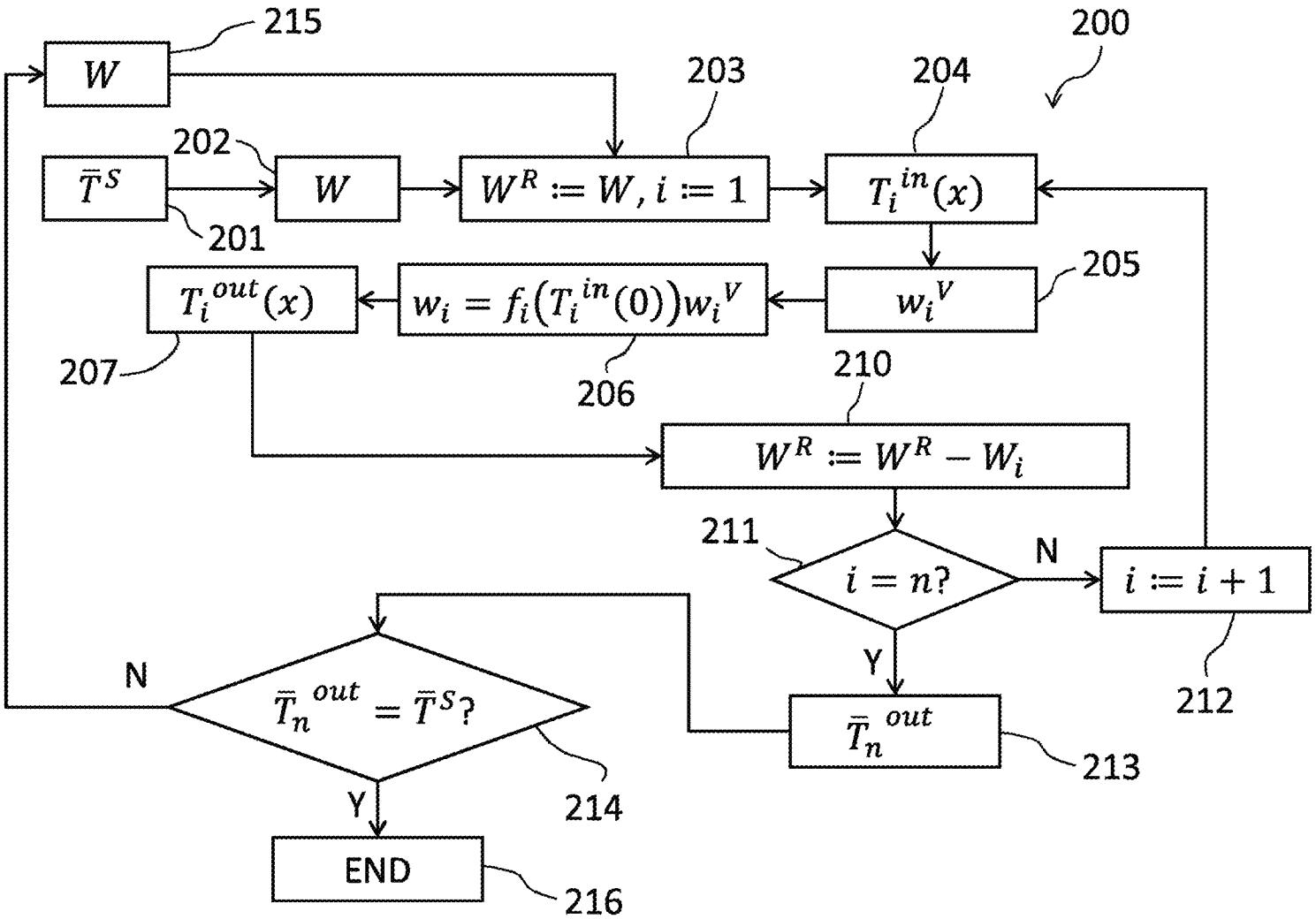
FIG. 4 shows a flow chart of a second exemplary embodiment of a method step of the method according to the invention.

FIG. 4 (FIG. 4) shows a second exemplary embodiment of the method step 200. This exemplary embodiment differs from the first exemplary embodiment described with reference to FIG. 3 only in a modification of the sub-step 206 and the omission of the sub-steps 208 and 209. Therefore, only the changes compared to the first exemplary embodiment described with reference to FIG. 3 will be described and commented on in the following.

In the sub-step 206 in this exemplary embodiment, during a simulated cooling section pass of a rolled product section, the set value $w_i$ of the coolant flow for the cooling device 21, 22, 23 with the current value of the running index i is determined according to $$w_i - f_i(T_i^{in}(0)w_i^V \quad (9).$$

In equation (9) $w_i^V$ is the default value which was determined in the previous execution of sub-step 205 for the coolant flow of the cooling device 21, 22, 23 with the current value of the running index i. $T_i^{in}(0)$ is a value of the surface temperature of the rolled product surface 29 upon entry into the active region 31, 32, 33 of this cooling device 21, 22, 23, which is derived from the temperature distribution $T_i^{in}(x)$ accepted during the previous execution of the sub-step 204. In the event that the rolled product surface 29 is the bottom surface of the rolled product 15, in equation (9) and FIG. 4 $T_i^{in}(0)$ should be replaced by $T_i^{in}(d)$ or the selection of the coordinate x should be adapted in such a way that x=0 denotes the bottom surface of the rolled product 15.

$f_i(T)$ is a function that is zero for $T \leq T^{min}$, for $T \geq T^{min} + \Delta T_i^{res}$ is one and in the interval $[T^{min}, T^{min} + \Delta T_i^{res}]$ increases strictly monotonically. For example, the function $f(T)$ in the interval $[T^{min}, T^{min} + \Delta T_i^{res}]$ is defined according to $$T^{min} \leq T \leq T^{min} + \Delta T_i^{res} : f_i(T) = \frac{T - T^{min}}{\Delta T_i^{res}} \quad (10)$$

$T^{min}$ is the minimum value accepted in the first method step 100 for a surface temperature of the rolled product surface 29 during transportation of the rolled product 15 through the cooling section 19. $\Delta T_i^{res}$ is a reserve temperature difference which is predetermined in such a way that the surface temperature of the rolled product surface 29 upon exit from the active region 31, 32, 33 of the cooling device 21, 22, 23 with the running index value i does not fall below the minimum value $T^{min}$ even if the surface temperature of the rolled product surface 29 upon entry into this active region 31, 32, 33 is greater than $T^{min} + \Delta T_i^{res}$ and the coolant flow delivered onto the rolled product surface 29 by the cooling device 21, 22, 23 with the running index value i is maximum, i.e., accepts the maximum value $w_i^{max}$ specific to the cooling device 21, 22, 23. $\Delta T_i^{res}$ is determined, for example, in a separate simulation of a cooling section pass of the rolled product 15 or on the basis of a mathematical model of the cooling section 19 in dependence on a heating temperature of the heating furnace 3 and the transport speed of the rolled product 15. The reserve temperature difference $\Delta T_i^{res}$ can depend on the value of the running index i, i.e., different reserve temperature differences can be specified for different cooling devices 21, 22, 23.

The second exemplary embodiment of the method step 200 shown in FIG. 4 is simpler than the first exemplary embodiment shown in FIG. 3 because the sub-steps 208 and 209 and thus the potential iteration of the sub-steps 207 to 209 are omitted. In particular, the second exemplary embodiment of method step 200 generally requires less computing effort than the first exemplary embodiment and therefore generally also requires a shorter computing time or a lower computing capacity. By contrast, the first exemplary embodiment of method step 200 generally enables faster cooling of the rolled product 15 than the second exemplary embodiment, since the iteration of sub-steps 207 to 209 enables a more precise adaptation of the set values for the coolant flows of the cooling devices 21, 22, 23 to the minimum value $T^{min}$.

It has already been explained above that one embodiment of the method according to the invention provides for the method steps 200 and 300 to be carried out successively for rolled product sections of the rolled product 15 which pass successively through the active regions 31, 32, 33 of the cooling devices 21, 22, 23. In this embodiment of the method according to the invention, method step 200 is carried out, for example, for each rolled product section according to one of the exemplary embodiments described with reference to FIG. 3 or 4. Alternatively, however, it is also possible to modify the exemplary embodiments described with reference to FIGS. 3 and 4 for this embodiment of the method according to the invention.

Figure 5:
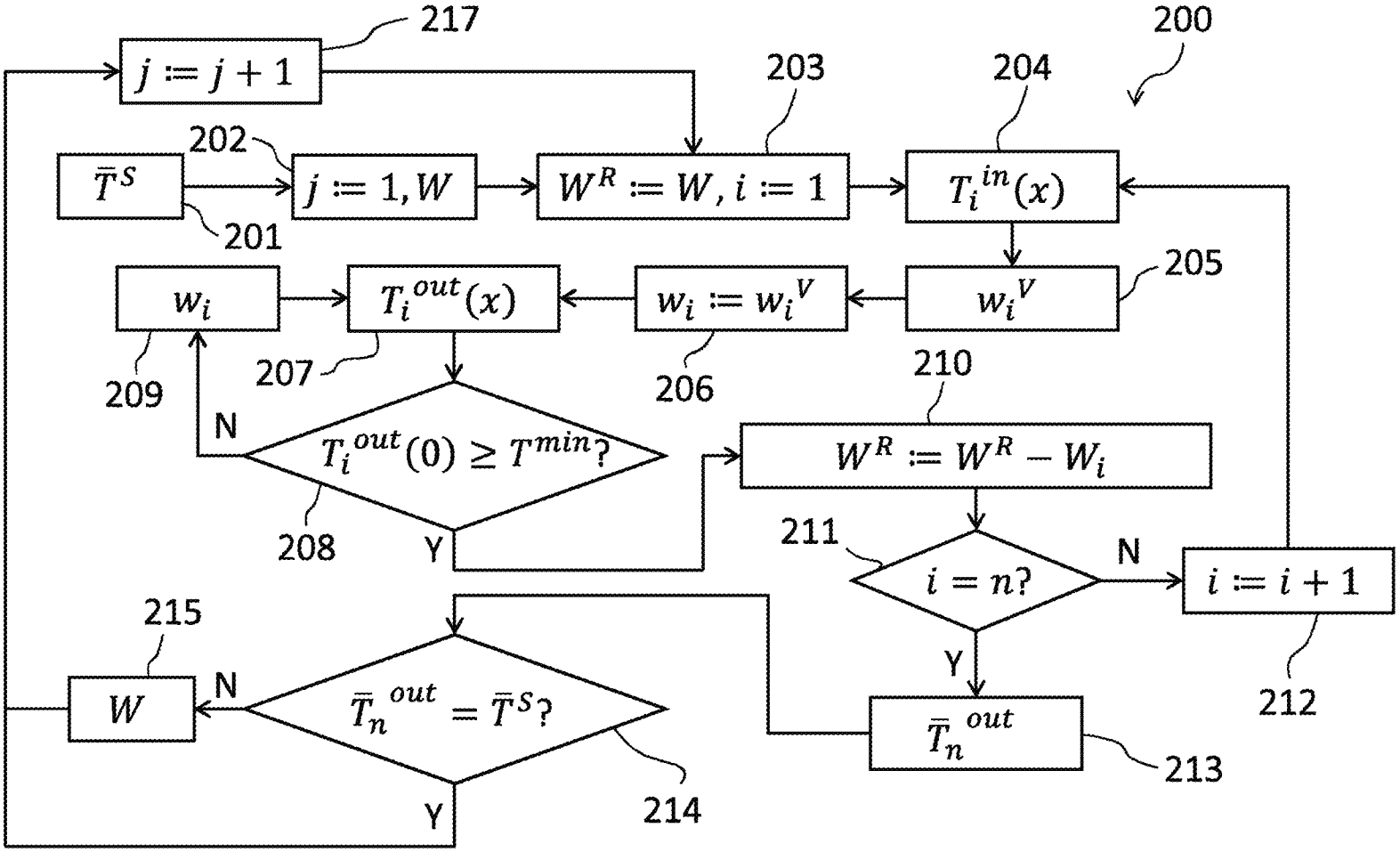
FIG. 5 shows a flow chart of a third exemplary embodiment of a method step of the method according to the invention.

FIG. 5 (FIG. 5) shows such a modification of the exemplary embodiment shown in FIG. 3. In this modification, a second running index j is used, which numbers the rolled product sections. In the second sub-step 202, as in the exemplary embodiment shown in FIG. 3, an initial total coolant quantity W of coolant 35 is received. In addition, in the second sub-step 202, the second running index j is assigned the value 1 as initial value. The sub-steps 203 to 214 are carried out for the relevant current value of the second running index j, i.e., for the associated rolled product section, in the same way as sub-steps 203 to 214 of the exemplary embodiment shown in FIG. 3.

In the event that the average temperature $\overline{T}_n^{out}$ calculated in sub-step 213 matches, with sufficient accuracy, the target average temperature $\overline{T}^S$ of the rolled product section after the cooling section pass, the value of the second running index j is now incremented in a sub-step 217 after sub-step 214. In the event that the average temperature $\overline{T}_n^{out}$ does not match the target average temperature $\overline{T}^S$ of the rolled product section with sufficient accuracy after the cooling section pass, the value of the total coolant quantity W is changed in sub-step 215, as in the exemplary embodiment shown in FIG. 3, and then the value of the second running index j is incremented in sub-step 217. In doing so, it is accepted that rolled product sections with small values of the second running index j have an average temperature after the cooling section pass that does not yet match the target average temperature $\overline{T}^S$ with sufficient accuracy.

After sub-step 217, sub-step 203 is carried out for the new value of the second running index j, i.e., a simulation of the cooling section pass of the subsequent rolled product section is started with a possibly changed total coolant quantity W. In the exemplary embodiment shown in FIG. 5, a cooling section pass is thus simulated exactly once for each rolled product section and a total coolant quantity W, possibly adapted in sub-step 215, is transferred to the simulation of the cooling section pass of the subsequent rolled product section. In this way, the second method step 200 carried out for a rolled product section is linked to the second method step 200 carried out for the subsequent rolled product section. After each execution of the second method step 200, for each cooling device 21, 22, 23, the set value $w_i$ of the coolant flow determined in this embodiment of method step 200 is stored for the relevant value of the second running index j. The set values $w_i$ stored for a value of the second running index j are not overwritten by the set values $w_i$ determined for another value of the second running index j.

The repeated execution of the second method step 200 is terminated when the second running index j reaches a final value. For example, after each execution of the second method step 200, it is checked whether the second running index j has reached the final value, and sub-step 217 is only carried out if this is not the case. Otherwise, the repeated execution of the second method step 200 is terminated. This is not shown in FIG. 5 for the sake of clarity.

Furthermore, in FIG. 5, strictly speaking, variables that have an index i or n would have to have an additional index j if these variables can differ from each other for different values of the second running index j. For example, the set value would have to be referred to by $w_{ij}$ instead of $w_i$. This has also been omitted in FIG. 5 for the sake of clarity.

The third method step 300 can also be carried out separately for each rolled product section and independently of the other rolled product sections. For one value k of the second running index, the third method step 300 can already be carried out, in which, by means of the cooling devices 21, 22, 23, during the cooling section pass of the rolled product section with the value k of the second running index, the coolant flow $w_i$ determined for this value k is delivered onto the rolled product section, while the second method step 200 is carried out for values j of the second running index with j>k is carried out. For this purpose, it is determined for each cooling device 21, 22, 23 in method step 300, in dependence on the transport speed or on the temporal course of the transport speed, when the rolled product section with the value k will be in the active region 31, 32, 33 of the cooling device 21, 22, 23. Taking into account the associated delay time, the cooling device 21, 22, 23 is then set in such a way that it delivers the coolant flow $w_i$ determined for this value k exactly when the rolled product section with the value k is located in the active region 31, 32, 33 of the cooling device 21, 22, 23.

Figure 6:
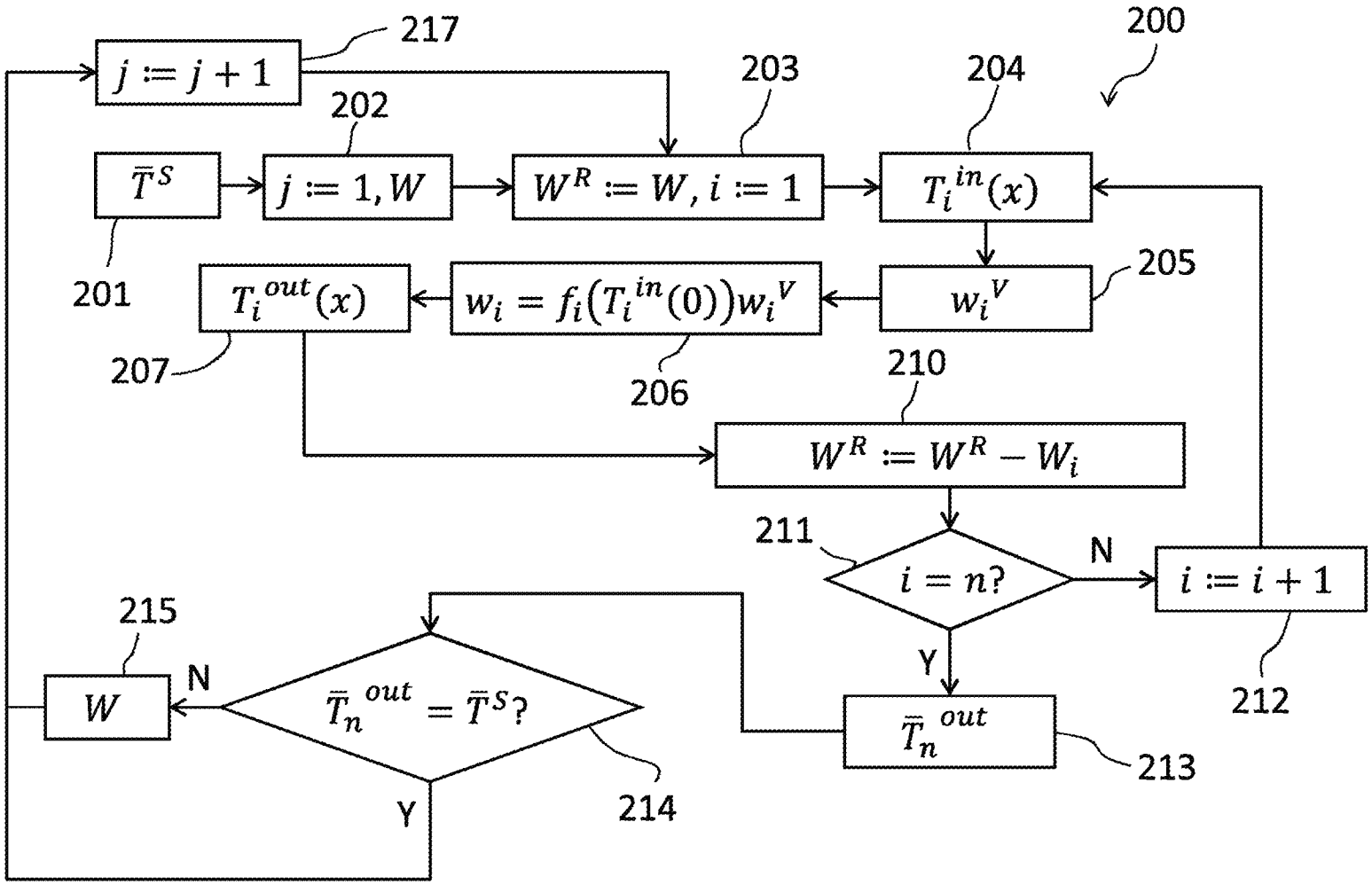
FIG. 6 shows a flow diagram of a fourth exemplary embodiment of a method step of the method according to the invention.

FIG. 6 (FIG. 6) shows a modification analogous to FIG. 5 of the exemplary embodiment of the second method step 200 shown in FIG. 4.

The exemplary embodiments of the method according to the invention described above can also be carried out if the rolled product is transported multiple times through the cooling section 19. For example, the finishing train 9 can have a reversing stand through which the rolled product 15 is guided multiple times in alternating directions. The rolled product 15 can then also be transported through the cooling section 19 multiple times in alternating directions. In this case, the method steps 200 and 300 are carried out for each cooling section pass. In this case, for example, a second measurement point is provided downstream of the cooling section 19, i.e., between the intermediate roller table 7 and the finishing train 9, at which a surface temperature of a surface part of the rolled product surface 29 belonging to a rolled product section is recorded before the rolled product section passes through the cooling section 19 from the second measurement point. For a simulation of this cooling section pass of the rolled product section, an original initial enthalpy distribution and/or original initial temperature distribution is determined in dependence on the surface temperature of the surface part of the rolled product surface 29 belonging to the rolled product section detected at the second measurement point.

Furthermore, the intermediate roller table 7 can have a plurality of cooling sections 19, or a cooling section 19 can have a plurality of partial cooling sections, for each of which the method according to the invention is carried out separately (each partial cooling section is then understood as a cooling section in the sense of the invention). If, for example, in the intermediate roller table 7 there is arranged an intermediate measurement point, at which a surface temperature of the rolled product 15 is recorded, the method according to the invention can be carried out separately for a first partial cooling section or cooling section which is arranged between the first measurement point 39 and the intermediate measurement point, and for a second partial cooling section or cooling section which is arranged between the intermediate measurement point and the finishing train 9. An original initial temperature distribution and/or an original initial enthalpy distribution for the second partial cooling section or second cooling section is then determined in dependence on the surface temperature of the rolled product 15 recorded at the intermediate measurement point. The same procedure can be followed if a plurality of intermediate measurement points are arranged in the intermediate roller table 7, at each of which a surface temperature of the rolled product 15 is recorded.

Figure 7:
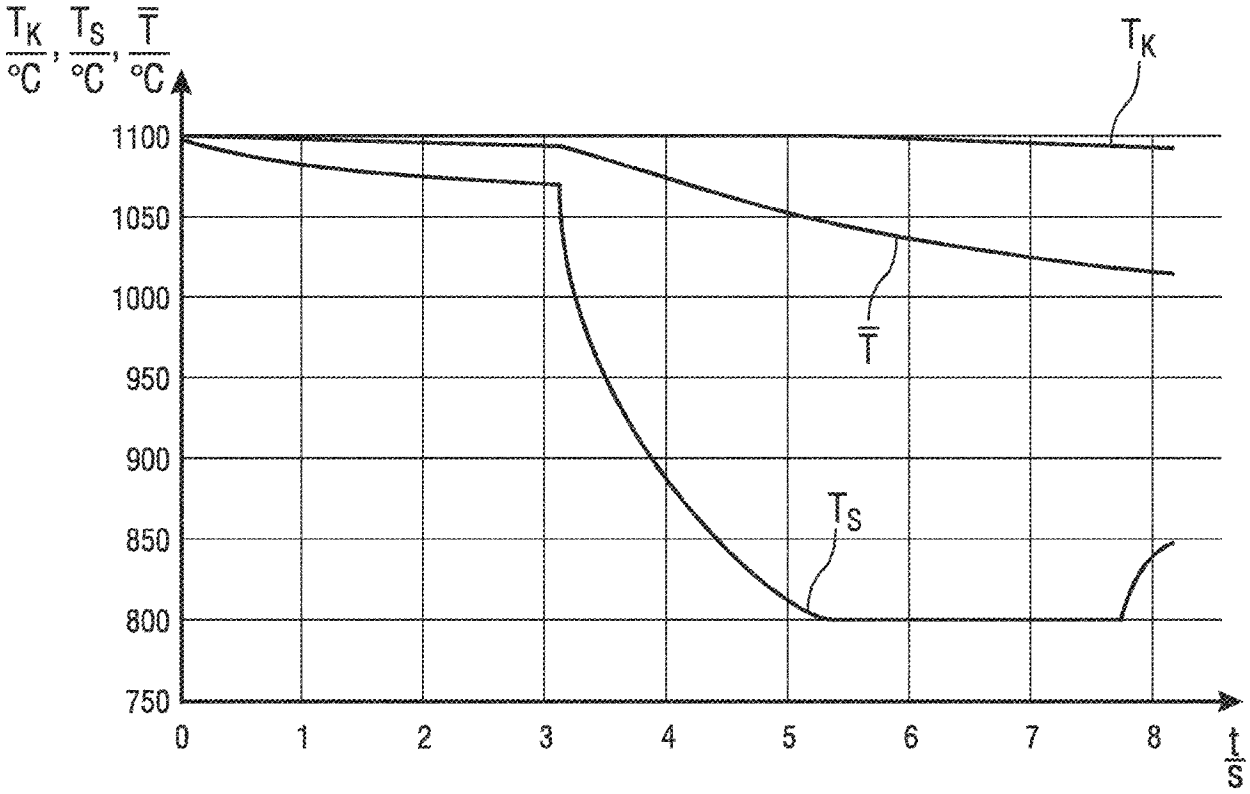
FIG. 7 shows temperature curves of temperatures in a rolled product section before and during a cooling section pass.

FIG. 7 (FIG. 7) shows examples of temperature curves of temperatures $T_K$, $T_S$ and $\bar{T}$, resulting from the application of the method according to the invention, in a rolled product section before and during a cooling section pass through a cooling section 19 in dependence on time t. Here, $T_K$ denotes a core temperature in the rolled product section in the middle between a top surface and a bottom surface of the rolled product 15. $T_S$ denotes a surface temperature at the rolled product surface 29 of the rolled product 15. $\bar{T}$ denotes an average temperature of the rolled product section, which is defined analogously to equation (8).

The rolled product section enters the cooling section 19 approximately 3 s after a time zero point. Due to the cooling effect of cooling devices 21, 22, 23 at the beginning of the cooling section 19, the surface temperature $T_S$ decreases quickly from about 1070° C. when the rolled product section enters the cooling section 19 to the minimum value $T^{min}$, which in this case is about 800° C. and is reached by the surface temperature $T_S$ already around 5.5 s after the time zero point. In the further course of the cooling section pass of the rolled product section, the surface temperature $T_S$ of the latter is kept relatively constantly at the minimum value $T^{min}$ by cooling devices 21, 22, 23 of the cooling section 19, in accordance with the invention, until the rolled product section exits the cooling section 19 approximately 7.7 s after the time zero point. Thereafter, the surface temperature $T_S$ increases again due to the lack of cooling, since heat is conducted from the interior of the rolled product section to the rolled product surface 29. The core temperature $T_K$ of the rolled product section remains relatively constant at around 1100° C. during the cooling section pass. The average temperature $\bar{T}$ of the rolled product section drops from around 1090° C. to around 1020° C. during the cooling section pass.

Although the invention has been illustrated and described in detail by preferred exemplary embodiments, the invention is not limited by the disclosed examples, and other variations may be derived by a person skilled in the art without departing from the scope of protection of the invention.

LIST OF REFERENCE SIGNS

1 hot rolling mill
3 heating furnace
5 roughing train
7 intermediate roller table
9 finishing train
11 outlet cooling area
13 coiler area
15 rolled product
17 roughing train rolling stand
19 cooling section
21, 22, 23 cooling device
25 transport roller
27 control unit
29 rolled product surface
31, 32, 33 active region
35 coolant
37 measuring device
39 measurement point
41 finishing train rolling stand
43 finish train cooling device
45 finishing train coolant
47,49 outlet cooling device
51 outlet coolant
53 rolling product coiler
100, 200, 300 method step
201 to 217 sub-step
t time
$T_K$ core temperature
$T_S$ surface temperature
$\overline{T}$ average temperature

The invention claimed is:

1. A method for cooling a rolled product in a cooling section which is arranged upstream of a finishing train of a hot rolling mill, comprising:

transporting the rolled product through the cooling section along a cooling section path one of:
one time at a predetermined transport speed; and
more than one time in alternating directions, each time at the predetermined transport speed;

arranging along the cooling section path one of:
a cooling device with an active region; and
a plurality of cooling devices arranged one behind the other, each with an active region, the active regions of adjacent cooling devices being directly adjacent to one another;

wherein each cooling device is configured to deliver, in its active region a coolant flow of a coolant onto a rolled product surface of the rolled product, which can be set between the value zero and a maximum value specific to the cooling device;

accepting a minimum value for a surface temperature of the rolled product surface during the transport of the rolled product through the cooling section;

assigning, in order to maintain the minimum value, a set value for the coolant flow to each cooling device for each cooling section pass through the cooling section, and delivering a coolant flow onto the rolled product surface by each cooling device for each cooling section pass, which is set to the set value assigned to the relevant cooling device for the cooling section pass;

wherein, in order to determine the set values for a cooling section pass, the cooling section pass is simulated at least once for a rolled product section of the rolled product through the cooling section at the predetermined transport speed;

wherein, for each simulated cooling section pass, the following values are determined successively for each cooling device:

a default value for a coolant flow to be delivered by the cooling device is received or determined at the latest immediately before the rolled product section enters the active region of the cooling device;

based on at least one of an initial enthalpy distribution and an initial temperature distribution in the rolled product section upon entry into the active region of the cooling device, at least one of an enthalpy distribution and a temperature distribution in the rolled product section upon exit from the active region of the cooling device using a physical model;

the set value so that it quasi-maximizes the coolant flow to be delivered from the cooling device onto the rolled product surface under secondary conditions that the set value does not exceed the default value and a surface temperature of the rolled product surface derived from at least one of the initial enthalpy distribution and the initial temperature distribution or a further surface temperature of the rolled product surface derived from at least one of the calculated enthalpy distribution and a calculated temperature distribution of the rolled product section does not fall below the minimum value upon exit from the active region of the cooling device;

wherein for each two active regions passed through in immediate succession by the rolled product section during the cooling section pass, at least one of the enthalpy distribution and the calculated temperature distribution calculated for the first active region passed through is assigned to the other active region as at least one of the initial enthalpy distribution and initial temperature distribution upon entry into the other active region; and wherein at least one of an original initial enthalpy distribution and an original initial temperature distribution is accepted for the first cooling device through which the rolled product section passes during the cooling section pass.

2. The method as claimed in claim 1, wherein:

at least one cooling device for each simulated cooling section pass of a rolled product section is assigned the set value according to $W_i = f_i(T_i^{in}(0) w_i^V)$;

$w_i^V$ is the default value for the coolant flow to be delivered by the cooling device;

$T_i^{in}(0)$ is the surface temperature of the rolled product surface, derived from at least one of the initial enthalpy distribution and the initial temperature distribution, upon entry into the active region of the cooling device;

$T^{min}$ is the minimum value for the surface temperature of the rolled product surface;

$\Delta T_i^{res}$ is a predeterminable reserve temperature difference; and $f_i(T)$ is a function that is zero for $T \leq T^{min}$, is one for $T \geq T^{min} + \Delta T_i^{res}$, and in the interval $[T^{min}, T^{min} + \Delta T_i^{res}]$ increases strictly monotonically.

3. The method as claimed in claim 1, wherein the set value for at least one cooling device is determined for each simulated cooling section pass by first calculating the surface temperature of the rolled product surface upon exit from the active region of the cooling device for the default value for the coolant flow of the cooling device and setting the set value equal to the default value if the surface temperature calculated for the default value does not fall below the minimum value, and otherwise the calculation of the surface temperature upon exit from the active region is iterated for at least one coolant flow that is smaller than the default value in order to determine a set value of the coolant flow for which the calculated surface temperature upon exit from the active region matches the minimum value with a predetermined accuracy.

4. The method as claimed in claim 1, wherein for each cooling device a maximum value of the coolant flow specific to the relevant cooling device is accepted as the default value for the coolant flow for each simulated cooling section pass.

5. The method as claimed in claim 1, wherein a total coolant quantity of coolant is determined for a simulation of a cooling section pass of a rolled product section, which coolant quantity is to be delivered at most in total onto the surface part of the rolled product surface belonging to the rolled product section during the cooling section pass, and the default values for the coolant flows of the simulated cooling section pass are determined in dependence on the total coolant quantity and the transport speed specified for the cooling section pass.

6. The method as claimed in claim 5, wherein a target average temperature of the rolled product is received after a cooling section pass, in each simulation of a cooling section pass of a rolled product section an average temperature of the rolled product section at the end of the cooling section pass is calculated and, if the calculated average temperature does not correspond sufficiently accurately to the target average temperature, the total amount of coolant is changed for a subsequent simulation of a cooling section pass of a rolled product section in order to bring the calculated average temperature into line with the target average temperature.

7. The method as claimed in claim 5, wherein:

a residual coolant quantity is assigned to each cooling device during a simulation of a cooling section pass of a rolled product section;

the total coolant quantity is assigned to the first cooling device of the cooling section pass as the residual coolant quantity and each further cooling device is assigned, as residual coolant quantity, the residual coolant quantity of the preceding cooling device of the cooling section pass minus the coolant quantity that would be delivered by the preceding cooling device according to the coolant flow set value determined for it on the surface part of the rolled product surface belonging to the rolled product section, and the default value of the coolant flow of a cooling device is calculated according to $w_i^v = w_i^{max} \min(1, W^R/W_i^{max})$; and $w_i^{max}$ is the maximum value of the coolant flow of the cooling device, $W^R$ is the residual coolant quantity assigned to the cooling device and $W_i^{max}$ is a maximum coolant quantity that can be delivered with the cooling device onto the surface part of the rolled product surface belonging to the rolled product section during the cooling section pass.

8. The method as claimed in claim 5, wherein if a set value is determined for a cooling device during the simulation of the cooling section pass of the rolled product section which is smaller than a default value received for the cooling device, and if there is at least one subsequent cooling device which is reached later during the cooling section pass and for which a default value received is smaller than the maximum value of the coolant flow of this cooling device, the default value for at least one such subsequent cooling device is increased in order to adapt the total quantity of coolant to be delivered onto the surface part of the rolled product surface belonging to the rolled product section during the cooling section pass to the total quantity of coolant determined for the cooling section pass.

9. The method as claimed in claim 1, wherein at least one of a one-dimensional heat conduction equation describing the enthalpy distribution and a temperature distribution in the rolled product section along a rolled product thickness direction is solved to calculate at least one of the enthalpy distribution and a further temperature distribution in the rolled product section upon exit from the active region of a cooling device during a simulation of a cooling section pass of the rolled product section.

10. The method as claimed in claim 9, wherein, to solve the heat conduction equation, boundary conditions are taken into account which parameterize cooling of the rolled product section by thermal radiation, coolant delivered onto the rolled product surface, heat dissipated to the ambient air from the rolled product section and heat dissipated from the rolled product section to transport rollers transporting the rolled product.

11. The method as claimed in claim 1, wherein the surface temperature of a surface part of the rolled product surface belonging to the rolled product section is measured at at least one measurement point, which is passed by a rolled product section before a cooling section pass, and at least one of the original initial enthalpy distribution and a further original initial temperature distribution for a simulation of a cooling section pass of the rolled product section are determined in dependence on the at least one measured surface temperature.

12. The method as claimed in claim 1, wherein the method is performed for a rolled product top surface or a rolled product bottom surface or separately for the rolled product top surface and the rolled product bottom surface of the rolled product.

13. A cooling section for cooling a rolled product upstream of a finishing train of a hot rolling mill, the cooling section comprising:

a cooling device or a plurality of cooling devices arranged one behind the other along a cooling path through the cooling section, with each of which a coolant flow of a coolant can be delivered onto a rolled product surface of the rolled product, which can be set between the value zero and a maximum value specific to the cooling device;

a plurality of transport rollers which are designed to transport the rolled product along the cooling section path through the cooling section; and a control unit configured to operate the cooling section in accordance with the method as claimed in claim 1.

14. The cooling section as claimed in claim 13, wherein a plurality of cooling devices are arranged along the cooling section path according to the respective maximum values of the deliverable coolant flows, so that the respective maximum values decrease monotonically towards the finishing train.

* * * * *